US009771952B2

(12) United States Patent
Ueno et al.

(10) Patent No.: US 9,771,952 B2
(45) Date of Patent: Sep. 26, 2017

(54) SCREW COMPRESSOR

(71) Applicant: DAIKIN INDUSTRIES, LTD., Osaka-shi, Osaka (JP)

(72) Inventors: Hiromichi Ueno, Sakai (JP); Takashi Inoue, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 195 days.

(21) Appl. No.: 14/651,569

(22) PCT Filed: Dec. 12, 2013

(86) PCT No.: PCT/JP2013/007336
§ 371 (c)(1),
(2) Date: Jun. 11, 2015

(87) PCT Pub. No.: WO2014/097590
PCT Pub. Date: Jun. 26, 2014

(65) Prior Publication Data

US 2015/0308458 A1 Oct. 29, 2015

(30) Foreign Application Priority Data

Dec. 17, 2012 (JP) ..... 2012-274860

(51) Int. Cl.
*F04D 29/70* (2006.01)
*F04C 18/16* (2006.01)
(Continued)

(52) U.S. Cl.
CPC ..... *F04D 29/70* (2013.01); *F04C 18/16* (2013.01); *F04C 18/52* (2013.01);
(Continued)

(58) Field of Classification Search
CPC ..... F04C 18/52; F04C 18/16–18/20; F04C 18/48–18/565; F04C 18/56;
(Continued)

(56) References Cited

U.S. PATENT DOCUMENTS 3,101,171 A * 8/1963 Fraser ..... F04C 29/04 418/201.1
6,039,551 A * 3/2000 Takeuchi ..... F04C 2/086 184/6.16

(Continued)

FOREIGN PATENT DOCUMENTS

JP 2002-70778 A 3/2002

OTHER PUBLICATIONS

European Search Report of corresponding EP Application No. 13 86 5652.5 dated Jun. 29, 2016.

(Continued)

*Primary Examiner* — Mark Laurenzi
*Assistant Examiner* — Xiaoting Hu
(74) *Attorney, Agent, or Firm* — Global IP Counselors, LLP

(57) ABSTRACT

A screw compressor includes a casing, a screw rotor, a low-pressure-side bearing, and a low-pressure-side bearing holder holding the low-pressure-side bearing. The screw rotor is housed in the casing to form a compression mechanism to compress a refrigerant. The low-pressure-side bearing is arranged in a low-pressure-side region inside the casing and rotatably supports a drive shaft of the screw rotor. The casing has a suction port with an opening facing the low-pressure-side bearing holder as viewed along an axial direction. A filter member is attached to the suction port to filter out contaminants contained in the refrigerant being sucked into the casing. The filter member has a cylindrical shape with a bottom. A peripheral portion of the filter member adjacent to an opening of the filter member is fixed to the suction port. The bottom of the filter member is fixed to the low-pressure-side bearing holder.

3 Claims, 5 Drawing Sheets

(51) Int. Cl.

| | |
|---|---|
| ***F04C 18/52*** | (2006.01) |
| ***F04C 29/12*** | (2006.01) |
| ***F04C 29/00*** | (2006.01) |
| *F04C 13/00* | (2006.01) |

(52) U.S. Cl.
CPC ..... *F04C 29/0092* (2013.01); *F04C 29/12* (2013.01); *F04D 29/701* (2013.01); *F04C 13/005* (2013.01); *F04C 2210/62* (2013.01); *F04C 2240/806* (2013.01)

(58) Field of Classification Search
CPC .... F04C 29/0092; F04C 29/12; F04C 13/005; F04D 29/70; F04D 29/701
USPC ..... 418/270, DIG. 1, 196, 197, 89, 47
See application file for complete search history.

(56) References Cited

U.S. PATENT DOCUMENTS 6,045,344 A * 4/2000 Tsuboi ..... F04C 29/026 418/100
2004/0086409 A1* 5/2004 Tsuboi ..... F01C 21/02 418/201.1
2004/0184940 A1* 9/2004 Nakane ..... F04C 29/04 418/55.1
2008/0112832 A1* 5/2008 Kato ..... F01C 21/02 418/201.1
2010/0092320 A1* 4/2010 Duppert ..... F04C 18/0215 418/55.6
2010/0247366 A1* 9/2010 Kato ..... F01C 21/10 418/201.1
2012/0134866 A1* 5/2012 Tsuboi ..... F04C 18/16 418/201.1
2012/0247139 A1* 10/2012 Yonemoto ..... F04C 18/16 62/208

OTHER PUBLICATIONS

International Preliminary Report of corresponding PCT Application No. PCT/JP2013/007336 dated Jul. 2, 2015.
International Search Report of corresponding PCT Application No. PCT/JP2013/073141 dated Mar. 18, 2014.

* cited by examiner

SCREW COMPRESSOR

CROSS-REFERENCE TO RELATED APPLICATIONS

This U.S. National stage application claims priority under 35 U.S.C. §119(a) to Japanese Patent Application No. 2012-274860, filed in Japan on Dec. 17, 2012, the entire contents of which are hereby incorporated herein by reference.

TECHNICAL FIELD

The present invention relates to a screw compressor.

BACKGROUND ART

A screw compressor of the known art includes a casing and a screw rotor which is arranged in the casing and which constitutes a compression mechanism for compressing a refrigerant (see, for example, Japanese Unexamined Patent Publication No. 2002-070778).

This screw compressor includes a mesh filter which is attached to its suction port so as to filter out contaminants contained in the refrigerant being sucked. To facilitate maintenance, the filter adopted in this screw compressor is a cartridge type one in a cylindrical shape having a bottom.

CITATION LIST

Patent Document

SUMMARY

Technical Problem

In the screw compressor of the known art, however, a peripheral portion of the filter adjacent to its opening is fixed to the suction port of the screw compressor, and the cylindrical mesh portion of the filter extends inside the casing. Therefore, this mesh portion may be buckled and deformed.

Specifically, in the screw compressor, the discharge port of the compression mechanism is always open. Consequently, if the rotation of the screw rotor is stopped, a high-pressure gas in a high-pressure space flows backward through helical grooves of the screw rotor to enter a low-pressure space. Here, the filter in a cylindrical shape having a bottom has sufficient strength with respect to the internal pressure of a refrigerant which goes from the inside to the outside of the filter, but is easily deformed under the external pressure of the refrigerant which goes from the outside to the inside of the filter. That is to say, if the high-pressure gas flows backward in the manner as described above, the external pressure is applied to the filter, which adversely causes buckling deformation to the mesh portion of the filter in the axial direction.

Here, it may be possible to prevent the buckling deformation by reinforcing the filter either by covering the mesh portion of the filter with a punched plate or by attaching a steel plate member in the axial direction of the filter. However, the more strongly the filter is reinforced, the smaller the effective area of the filter becomes. This results in an increase in the pressure loss of the refrigerant and a decrease in suction efficiency.

In view of the foregoing, it is therefore an object of the present invention to prevent a filter member in a cylindrical shape having a bottom from being buckled and deformed when an external pressure is applied to the filter member.

Solution to the Problem

The present invention relates to a screw compressor including: a casing (11); a screw rotor (40) which is housed in the casing (11) and constitutes a compression mechanism (20) to compress a refrigerant; a low-pressure-side bearing (66) which is arranged in a low-pressure-side region inside the casing (11) and rotatably supports a drive shaft (21) of the screw rotor (40); and a low-pressure-side bearing holder (65) which holds the low-pressure-side bearing (66). The screw compressor of the present invention has the following feature as a means for solving the problem described above.

Specifically, in a screw compressor according to a first aspect of the present invention, the casing (11) has a suction port (11*a*), of which an opening faces the low-pressure-side bearing holder (65) as viewed in an axial direction, a filter member (30) is attached to the suction port (11*a*) to filter out contaminants contained in the refrigerant which is being sucked into the casing (11), and the filter member (30) is in a cylindrical shape having a bottom, where peripheral portion of the filter member (30) adjacent to an opening thereof is fixed to the suction port (11*a*) while a bottom of the filter member (30) is fixed to the low-pressure-side bearing holder (65).

According to the first aspect of the present invention, the casing (11) has a suction port (11*a*), of which an opening faces a low-pressure-side bearing holder (65) as viewed in an axial direction. A filter member (30) which is in a cylindrical shape having a bottom is attached to the suction port (11*a*). A peripheral portion of the filter member (30) adjacent to its opening is fixed to the suction port (11*a*). Further, a bottom of the filter member (30) is fixed to the low-pressure-side bearing holder (65).

This configuration allows for preventing the filter member (30) in a cylindrical shape having a bottom from being buckled and deformed when an external pressure is applied to the filter member (30).

Specifically, in the screw compressor, the discharge port of the compression mechanism (20) is always open. Therefore, when the rotation of the screw rotor (40) is stopped, a high-pressure gas in a high-pressure space (S2) flows backward through helical grooves (41) of the screw rotor (40) to enter a low-pressure space (S1), which results in that an external pressure is applied to the filter member (30).

According to the first aspect of the present invention, the bottom of the filter member (30) is fixed to the low-pressure-side bearing holder (65). Therefore, even if an external pressure is applied to the filter member (30), no buckling deformation is allowed to occur in the filter member (30) in the axial direction. Thus, the strength of the filter member (30) can be increased. In addition, the present invention eliminates the need for separately providing a punched plate or other members for the purpose of reinforcing the filter member (30), which allows for reducing the cost.

A second aspect of the present invention is an embodiment of the screw compressor according to the first aspect. In the second aspect, a reinforcing member (34) is attached to the bottom of the filter member (30) and fastened to the low-pressure-side bearing holder (65) with a fastening bolt (35).

According to the second aspect of the present invention, a reinforcing member (34) is attached to the bottom of the filter member (30). The reinforcing member (34) is fastened to the low-pressure-side bearing holder (65) with a fastening bolt (35). This configuration allows for ensuring some strength for the filter member (30).

Here, if the mesh portion at the bottom of the filter member (30) was fastened directly with a fastening bolt (35), the application of an external pressure to the filter member (30) could cause stress concentration around the head of the fastening bolt (35), which could rupture the bottom of the filter member (30).

To address this problem, according to the second aspect of the present invention, the bottom of the filter member (30) is fastened to the low-pressure-side bearing holder (65) via the reinforcing member (34) and with the fastening bolt (35). This configuration makes it difficult to rupture the mesh portion of the bottom of the filter member (30), and ensures sufficient strength for the filter member (30). In addition, the portion reinforced by the reinforcing member (34) is minimized, and therefore, a large effective filter area is ensured, which allows for reducing the pressure loss of the refrigerant.

A third aspect of the present invention is an embodiment of the screw compressor according to the second aspect. In the third aspect, an annular frame (33) which extends along a peripheral edge of the bottom of the filter member (30) is attached to the bottom of the filter member (30), the reinforcing member (34) is configured as a plate-like member which extends along the bottom of the filter member (30) in a radial direction, and the reinforcing member (34) is attached to, and extends across, the frame (33), and thereby attached to the bottom of the filter member (30).

According to the third aspect of the present invention, an annular frame (33) extending along a peripheral edge of the bottom of the filter member (30) is attached to the bottom of the filter member (30). The reinforcing member (34) is configured as a plate-like member which extends along the bottom of the filter member (30) in a radial direction. The reinforcing member (34) is attached to, and extends across, the frame (33).

This configuration, in which the peripheral edge of the bottom of the filter member (30) is reinforced by the frame (33), allows for increasing the stiffness of the filter member (30). The reinforcing member (34) that is attached to, and extends across, the frame (33) in the radial direction functions as a reinforcing beam, which allows for further increasing the stiffness of the filter member (30).

Advantages of the Invention

According to the present invention, since the bottom of the filter member (30) is fixed to the low-pressure-side bearing holder (65), no buckling deformation is allowed to occur in the filter member (30) in the axial direction even if an external pressure is applied to the filter member (30). Thus, the strength of the filter member (30) is increased. In addition, the present invention eliminates the need for separately providing a punched plate or other members for the purpose of reinforcing the filter member (30), which allows for reducing the cost.

Figure 5:
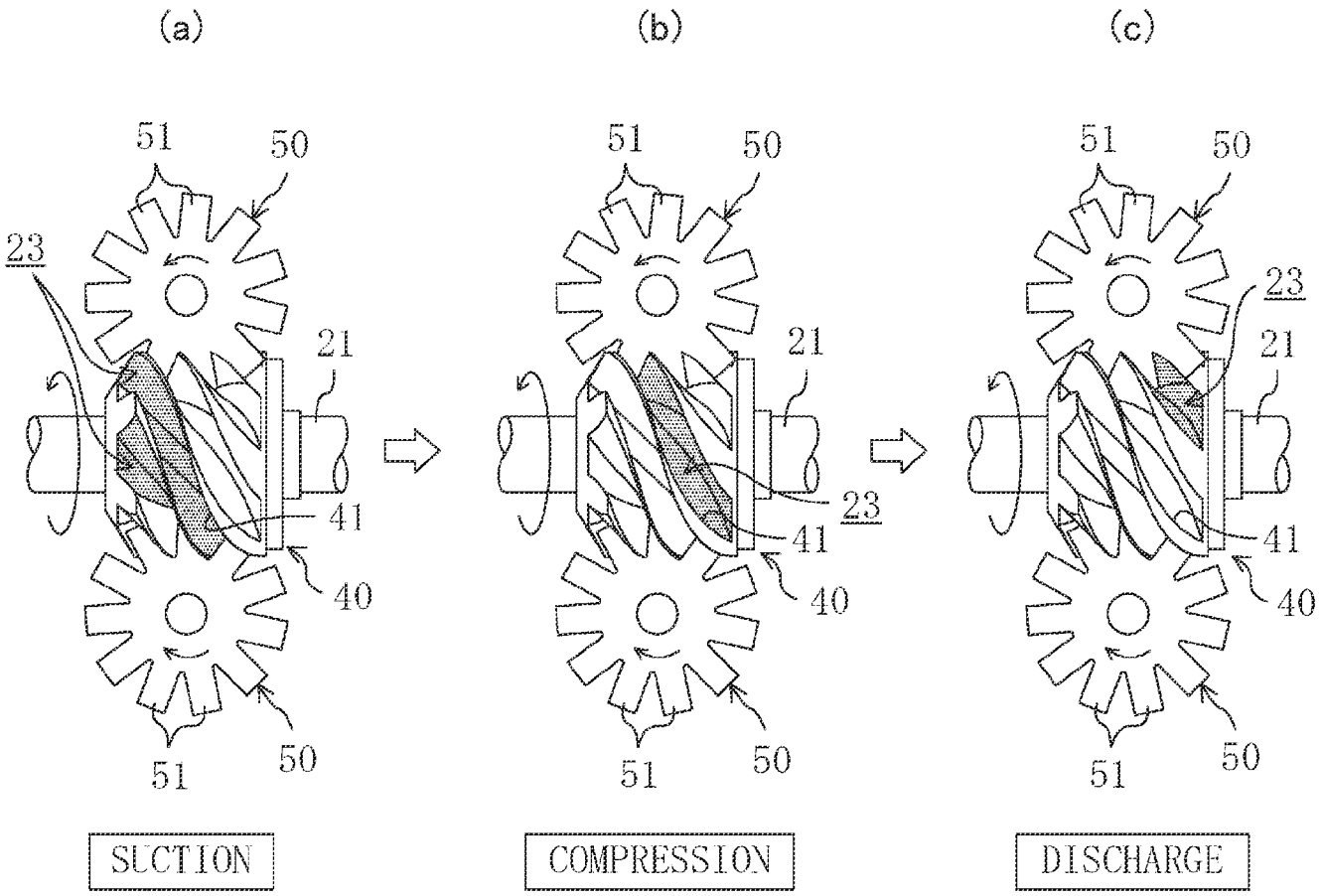

Portions (a) to (c) of FIG. 5 are plan views showing an operation of a compression mechanism of the screw compressor, wherein (a) shows a suction stroke, (b) shows a compression stroke, and (c) shows a discharge stroke.

Figure 4:
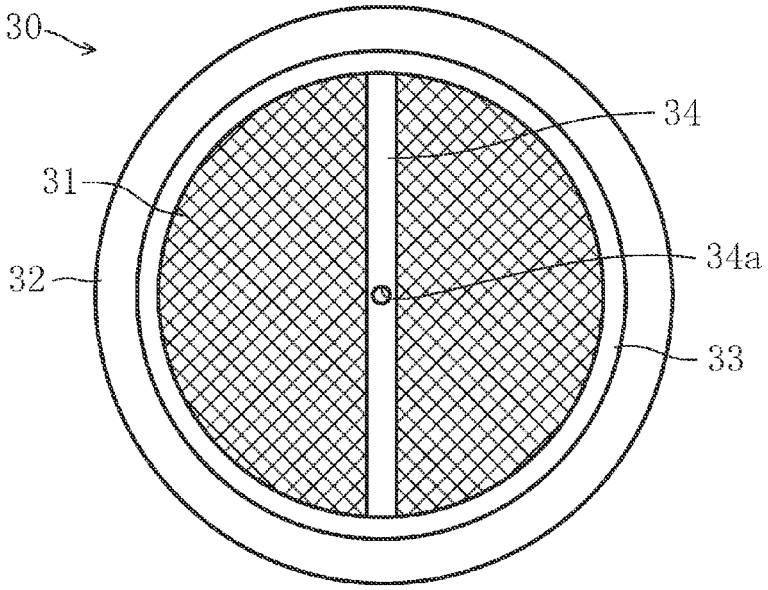
FIG. 4 is a bottom view showing a configuration for the filter member.
Figure 6:
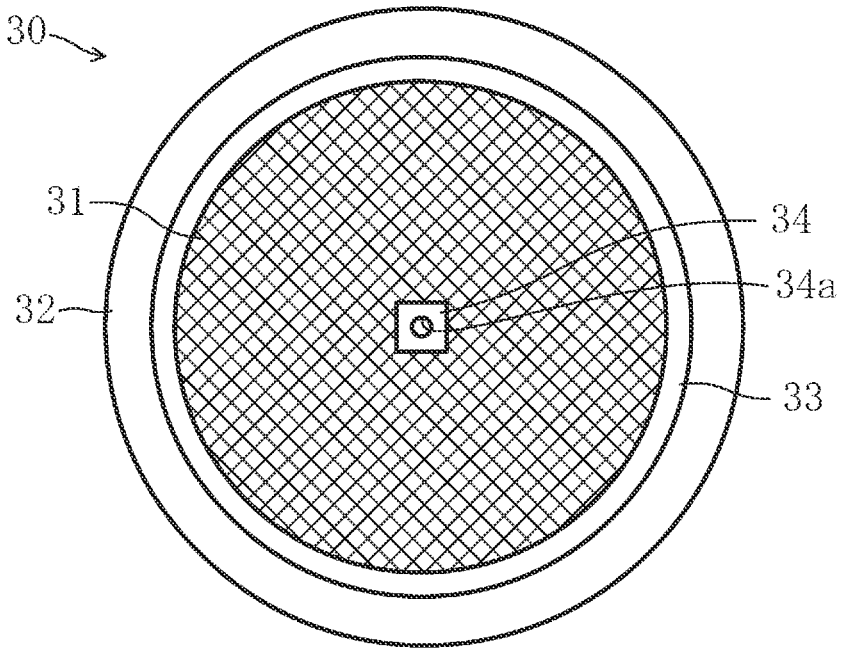

FIG. 6 is a view corresponding to FIG. 4 and showing a configuration for a filter member according to a variation of the present invention.

DESCRIPTION OF EMBODIMENTS

Embodiments of the present invention will be described below with reference to the drawings. Note that the following embodiments are merely preferred examples in nature, and are not intended to limit the scope, applications, and use of the invention.

Figure 1:
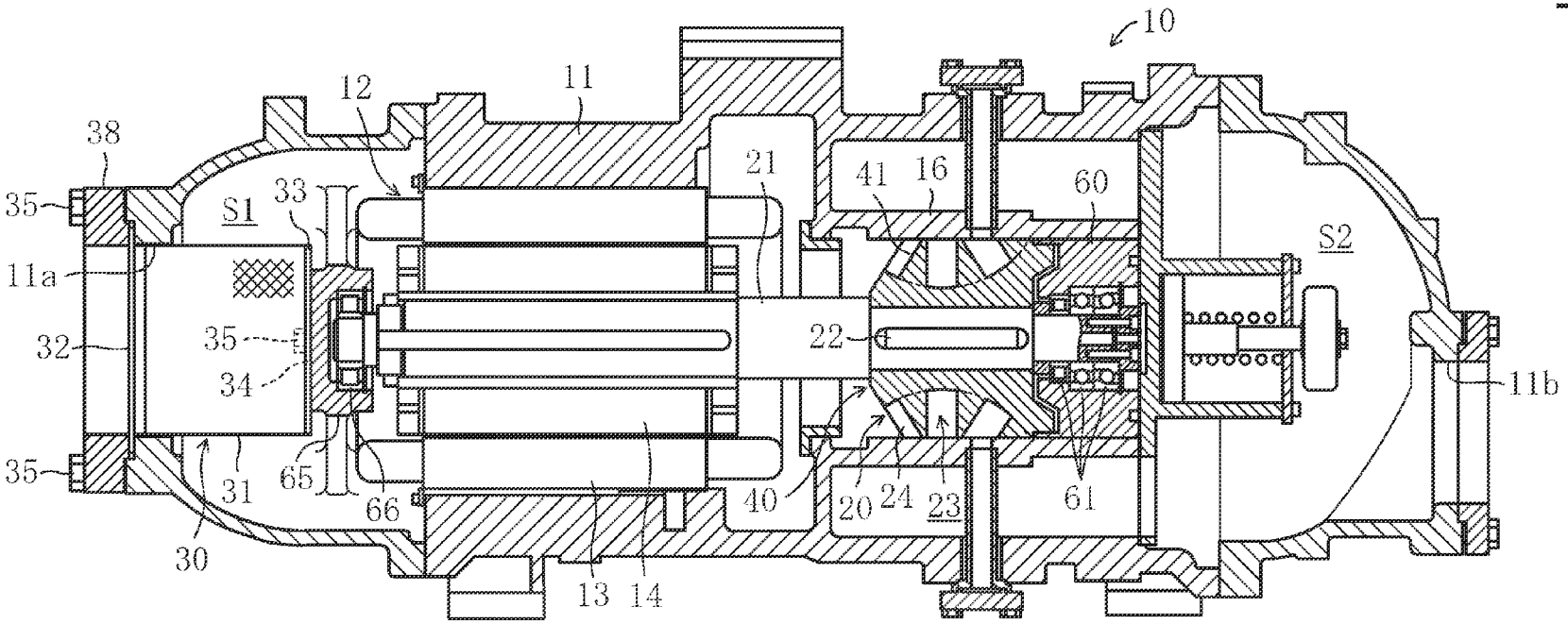
FIG. 1 is a longitudinal cross-sectional view showing a configuration for a screw compressor according to an embodiment of the present invention.
Figure 2:
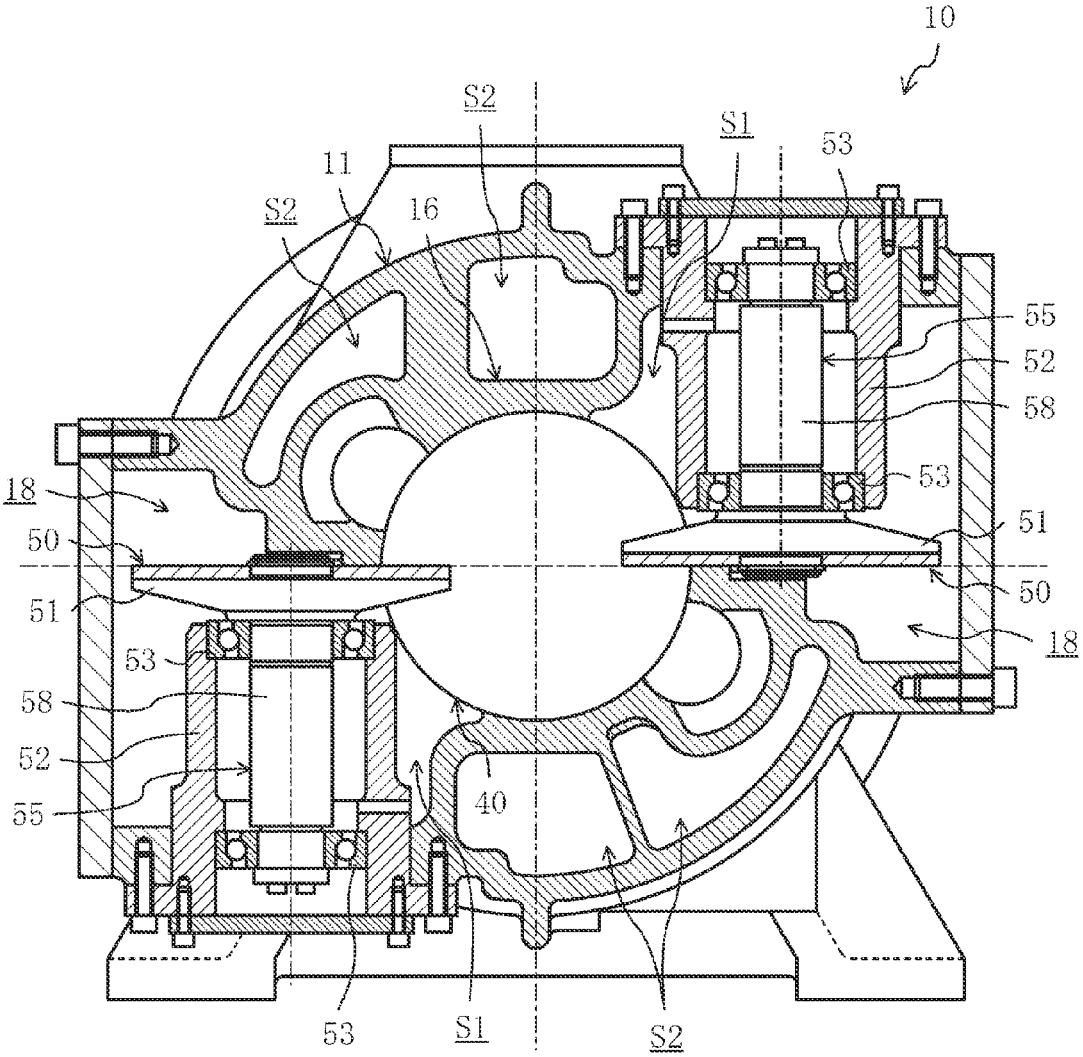
FIG. 2 is a transverse cross-sectional view showing a configuration for the screw compressor.

FIGS. 1 and 2 are respectively a longitudinal cross-sectional view and a transverse cross-sectional view that show a configuration for a screw compressor. As show in FIGS. 1 and 2, in the screw compressor (10), a compression mechanism (20) and a motor (12) which is configured to drive the compression mechanism (20) are housed in a metallic casing (11). The compression mechanism (20) is coupled to the motor (12) via a drive shaft (21).

The inside of the casing (11) is divided into a low-pressure space (S1) into which a low-pressure gaseous refrigerant flows, and a high-pressure space (S2) into which a high-pressure gaseous refrigerant that has been discharged from the compression mechanism (20) flows.

The motor (12) includes a stator (13) and a rotor (14). The stator (13) is fixed to the inner peripheral surface of the casing (11) in the low-pressure space (S1). The drive shaft (21), of which one end portion is coupled to the rotor (14), rotates along with the rotor (14).

The compression mechanism (20) includes a cylindrical wall (16) provided inside the casing (11), a screw rotor (40) arranged inside the cylindrical wall (16), and two gate rotors (50) meshing with the screw rotor (40).

The screw rotor (40) is a metallic member with a generally circular cylindrical shape. The outside diameter of the screw rotor (40) is set to be slightly smaller than the inside diameter of the cylindrical wall (16) such that the outer peripheral surface of the screw rotor (40) is in sliding contact with the inner peripheral surface of the cylindrical wall (16). The screw rotor (40) has, on its outer peripheral portion, a plurality of helical grooves (41) which helically extend from one axial end toward the other axial end of the screw rotor (40).

The screw rotor (40) is penetrated by the drive shaft (21). The screw rotor (40) is coupled to the drive shaft (21) by means of a key (22).

Each gate rotor (50) has a plurality of gates (51) which extend radially (see FIG. 5). Each gate rotor (50) is mounted on an associated one of metallic rotor support members (55). Each rotor support member (55) is arranged in an associated one of gate rotor chambers (18) which are defined in the casing (11) adjacent to the cylindrical wall (16).

In FIG. 2, the rotor support member (55) shown on the right of the screw rotor (40) is arranged such that the associated gate rotor (50) is located at the lower end thereof. On the other hand, in FIG. 2, the rotor support member (55) shown on the left of the screw rotor (40) is arranged such that the associated gate rotor (50) is located at the upper end thereof. Each rotor support member (55) has its shaft (58)

rotatably supported, via ball bearings (53), by a bearing housing (52) provided inside the associated gate rotor chamber (18).

In the compression mechanism (20), spaces surrounded by the inner peripheral surface of the cylindrical wall (16), the helical grooves (41) of the screw rotor (40), and the gates (51) of the gate rotors (50) serve as compression chambers (23). The suction side ends of the helical grooves (41) of the screw rotor (40) are opened to the low-pressure space (S1). These openings of the helical grooves serve as a suction section (24) of the compression mechanism (20).

One end portion of the drive shaft (21) is rotatably supported by a low-pressure-side bearing (66) which is arranged in the low-pressure space (S1). The low-pressure-side bearing (66) is held by a low-pressure-side bearing holder (65). The other end portion of the drive shaft (21) is rotatably supported by a high-pressure-side bearing (61) arranged on the high-pressure side of the compression mechanism (20). The high-pressure-side bearing (61) is held by a high-pressure-side bearing holder (60) which is fitted into the cylindrical wall (16) of the casing (11).

The casing (11) has a suction port (11*a*) beside the low-pressure space (S1). As viewed in the axial direction, the suction port (11*a*) is positioned such that its opining faces the low-pressure-side bearing holder (65). (In FIG. 1, the opening is located at the center of the left end of the casing (11).) The suction port (11*a*) has a filter member (30) attached thereto in order to filter out contaminants of relatively large sizes which are contained in the gaseous refrigerant that is being sucked into the casing (11).

The filter member (30) includes a mesh filter body (31) which is in a cylindrical shape having a bottom, and a flange (32) which projects radially outward from a peripheral portion adjacent to the opening of the filter body (31).

The filter body (31) is designed to have such a length that when the filter body (31) is inserted into the casing (11) through the suction port (11*a*), the bottom of the filter body (31) is in contact with the low-pressure-side bearing holder (65).

The flange (32) is in contact with the peripheral portion of the suction port (11*a*) when the bottom of the filter body (31) is in contact with the low-pressure-side bearing holder (65). The flange (32) retained between the peripheral portion of the suction port (11*a*) of the casing (11) and a ring-like fixing lid (38). The fixing lid (38) is fastened to the casing (11) with fastening bolts (35). In this manner, the peripheral portion of the filter member (30) adjacent to its opening is fixed to the suction port (11*a*).

Figure 3:
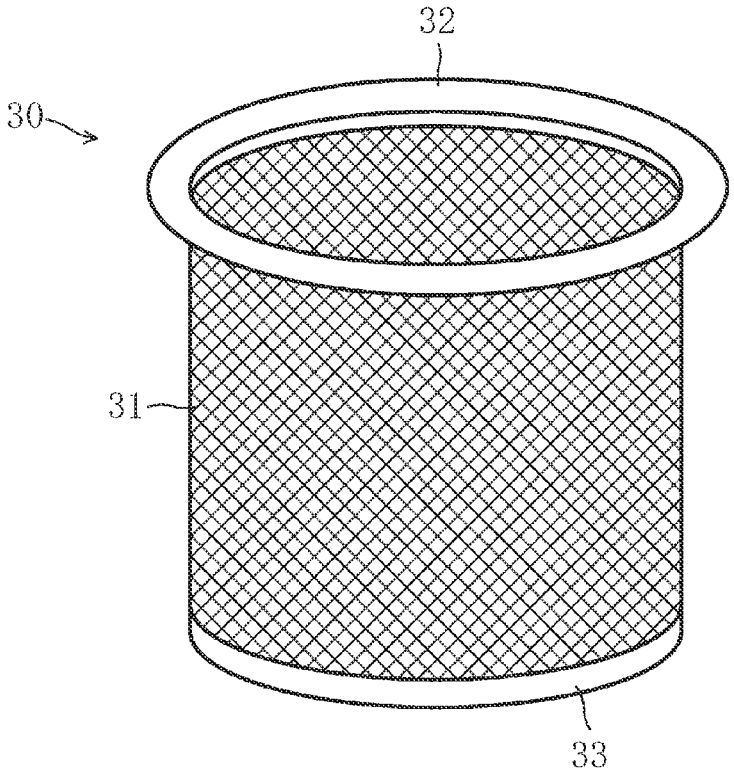
FIG. 3 is a perspective view showing a configuration for a filter member.

FIGS. 3 and 4 are respectively a perspective view and a bottom view that show a configuration for the filter member. As shown in FIGS. 3 and 4, an annular frame (33) and a reinforcing member (34) are attached to the bottom of the filter member (30). The reinforcing member (34) is attached to, and extends across, the frame (33).

The frame (33) extends along the peripheral edge of the bottom of the filter body (31), which allows for increasing the stiffness of the bottom of the filter body (31).

The reinforcing member (34) is configured as a plate-like member which extends in the radial direction of the filter body (31). The reinforcing member (34) has, at its center, an insertion hole (34*a*) through which the axis of another fastening bolt (35) is inserted. The bottom of the filter body (31) also has a hole which corresponds to the insertion hole (34*a*). The low-pressure-side bearing holder (65) has a screw hole (not shown) which corresponds to the insertion hole (34*a*).

As shown in FIG. 1, the bottom of the filter body (31) is fastened to the low-pressure-side bearing holder (65) via the reinforcing member (34) and with the fastening bolt (35). Thus, this configuration allows for preventing the filter member (30) from being buckled and deformed in the axial direction and increasing the strength of the filter member (30), even if the high-pressure gas in the high-pressure space (S2) flows backward through the helical grooves (41) of the screw rotor (40) and enters the low-pressure space (S1) to apply an external pressure to the filter member (30) when the screw rotor (40) is not rotating.

The casing (11) has, in its high-pressure space (S2), a discharge port (11*b*). In FIG. 1, the discharge port (11*b*) has its opening at the right end of the casing (11). The high-pressure refrigerant is discharged out of the casing (11) through the discharge port (11*b*).

—Operation—

The operation of the screw compressor (10) will now be described below. As shown in FIG. 1, when the motor (12) of the screw compressor (10) is started, the drive shaft (21) rotates to make the screw rotor (40) rotate. This rotation of the screw rotor (40) also makes the gate rotors (50) rotate, which results in that the compression mechanism (20) performs the same series of suction, compression, and discharge strokes a number of times. Here, these strokes will be described with attention focused on the compression chambers (23) indicated by shading in FIG. 5.

In Portion (a) of FIG. 5, the shaded compression chambers (23) communicate with the low-pressure space (S1). The helical grooves (41) that form these compression chambers (23) are meshed with associated ones of the gates (51) of the gate rotor (50) that is shown at the bottom of Portion (a) of FIG. 5. The rotation of the screw rotor (40) results in relative movement of the associated gates (51) toward the terminal ends of the helical grooves (41). Along with this relative movement, the volumes of the compression chambers (23) increase. As a result, the low-pressure gaseous refrigerant in the low-pressure space (S1) is sucked into the compression chambers (23) through the suction section (24).

When the screw rotor (40) further rotates, the compression mechanism enters the state shown in Portion (b) of FIG. 5. In Portion (b) of FIG. 5, the shaded compression chamber is completely closed. Specifically, the helical groove (41) that forms this compression chamber (23) is meshed with an associated one of the gates (51) of the gate rotor (50) that is shown at the top of Portion (b) of FIG. 5, and this associated gate (51) separates the compression chamber from the low-pressure space (S1). The rotation of the screw rotor (40) results in movement of the associated gate (51) toward the terminal end of the helical groove (41), and consequently, the volume of the compression chamber (23) gradually decreases. As a result, the gaseous refrigerant present in the compression chamber (23) is compressed.

When the screw rotor (40) further rotates, the compression mechanism enters the state shown in Portion (c) of FIG. 5. In Portion (c) of FIG. 5, the shaded compression chamber (23) is in communication with the high-pressure space (S2) through the discharge port (not shown). The rotation of the screw rotor (40) results in movement of the associated gate (51) toward the terminal end of the helical groove (41), and consequently, the compressed gaseous refrigerant is pushed out of the compression chamber (23) to enter the high-pressure space (S2).

<<Variation>>

FIG. 6 corresponds to FIG. 3 and shows a configuration for a filter member according to a variation of the present invention. As shown in FIG. 6, an annular frame (33) which extends along the peripheral edge of the bottom of the filter member (30) is attached to the bottom of the filter member (30). A reinforcing member (34) is also attached to the center of the bottom of the filter member (30).

The reinforcing member (34) is configured as a square plate with which the head of a fastening bolt (35) is to be in contact. The reinforcing member (34) has, at its center, an insertion hole (34*a*) through which the axis of the fastening bolt (35) is inserted. Thus, since the portion reinforced by the reinforcing member (34) is minimized, a large effective filter area is ensured, which allows for reducing the pressure loss of the refrigerant.

Though FIG. 6 shows an embodiment in which the annular frame (33) is attached, the frame (33) does not have to be provided. Also, the reinforcing member (34) is not limited to any particular shape, but may have a ring shape, for example.

INDUSTRIAL APPLICABILITY

As can be seen from the foregoing description, the present invention prevents a filter member in a cylindrical shape having a bottom from being buckled and deformed when an external pressure is applied to the filter member, which is so advantageous in practice that the present invention is very useful and has a broad range of industrial applicability.

What is claimed is:

1. A screw compressor comprising:

a casing;

a screw rotor housed in the casing to form a compression mechanism to compress a refrigerant;

a low-pressure-side bearing arranged in a low-pressure-side region inside the casing and rotatably supporting a drive shaft of the screw rotor; and a low-pressure-side bearing holder holding the low-pressure-side bearing, the casing having a suction port, with an opening of the suction port facing the low-pressure-side bearing holder as viewed along an axial direction, a filter member being attached to the suction port to filter out contaminants contained in the refrigerant being sucked into the casing, and the filter member having a mesh filter body having a cylindrical shape with a bottom, a peripheral portion of the filter member adjacent to an opening thereof being fixed to the suction port, a mesh portion at the bottom of the filter member being fixed to the low-pressure-side bearing holder, and the filter member being positioned such that the bottom of the filter body overlaps with the drive shaft as viewed in an axial direction of the drive shaft.

2. The screw compressor of claim 1, wherein a reinforcing member is attached to the bottom of the filter member and fastened to the low-pressure-side bearing holder with a fastening bolt.

3. The screw compressor of claim 2, wherein an annular frame extends along a peripheral edge of the bottom of the filter member and is attached to the bottom of the filter member, the reinforcing member is configured as a plate-shaped member and extends along the bottom of the filter member in a radial direction, and the reinforcing member is attached to, and extends across, the frame, and is thereby attached to the bottom of the filter member.

* * * * *